United States Patent [19]

Leung et al.

[11] Patent Number: 4,776,949

[45] Date of Patent: Oct. 11, 1988

[54] RECYCLE OF SECONDARY FROTH IN THE HOT WATER PROCESS FOR EXTRACTING BITUMEN FROM TAR SAND

[75] Inventors: Antony H. S. Leung, Sherwood Park; Teddy K. Kwong, Edmonton, both of Canada

[73] Assignees: Alberta Energy Company Ltd; Canadian Occidental Petroleum Ltd.; Esso Resources Canada Limited, all of Calgary; Gulf Canada Limited, Toronto; Her Majesty the Queen in right of Canada, as represented by The Minister of Natural Resources, Edmonton; Hbog-Oil Sands Limited Partnership, Calgary; Pancanadian Petroleum Limited, Calgary; Petro-Canada Inc., Calgary, all of Canada

[21] Appl. No.: 804,715

[22] Filed: Dec. 5, 1985

[51] Int. Cl.[4] ..... C10G 1/00

[52] U.S. Cl. ..... 208/390; 208/391

[58] Field of Search ..... 208/11 LE

[56] References Cited

U.S. PATENT DOCUMENTS

| | | | |
|---|---|---|---|
| 3,526,585 | 9/1970 | Camp | 208/11 LE |
| 3,607,720 | 9/1971 | Paulson | 208/11 LE |
| 4,462,892 | 7/1984 | Schran et al. | 202/11 LE |
| 4,474,616 | 10/1984 | Smith et al. | 208/11 LE |
| 4,533,459 | 8/1985 | Dente et al. | 208/11 LE |

FOREIGN PATENT DOCUMENTS

| | | | |
|---|---|---|---|
| 1011273 | 5/1977 | Canada | 208/11 LE |
| 1012083 | 6/1977 | Canada | 208/11 LE |
| 1055868 | 6/1979 | Canada | 208/11 LE |

*Primary Examiner*—H. M. S. Sneed
*Assistant Examiner*—William G. Wright
*Attorney, Agent, or Firm*—Millen & White

[57] ABSTRACT

Froth, produced by induced air flotation in the hot water process circuit for extracting bitumen from tar sand, is recycled and added to the fresh slurry being introduced to the primary separation vessel. An increase in bitumen recovered as primary froth from the circuit is produced.

2 Claims, 1 Drawing Sheet

RECYCLE OF SECONDARY FROTH IN THE HOT WATER PROCESS FOR EXTRACTING BITUMEN FROM TAR SAND

FIELD OF THE INVENTION

This invention relates to an improvement of the hot water process for extracting bitumen from tar sand.

BACKGROUND OF THE INVENTION

Tar sand is currently being exploited in the Athabasca region of Alberta by two large commercial plants. In general, these operations involve mining the tar sand, extracting the bitumen from the mined tar sand by the hot water process, and upgrading the recovered bitumen in a refinery-type circuit to produce synthetic crude oil.

The hot water process referred to is now well described in the literature. In summary, it comprises the steps of:

forming a hot aqueous tar sand slurry;

conditioning the slurry by agitating it in a rotating horizontal drum, to effect a preliminary dispersion of the bitumen and solids and to entrain air bubbles in the slurry;

screening the conditioned slurry, to remove oversize solids;

diluting the conditioned slurry with additional hot water;

introducing the diluted slurry into a thickener-like primary separation vessel and separating the greatest part of the bitumen from the solids by holding the diluted slurry for a period of time under quiescent conditions in said vessel, so that aerated bitumen may rise to produce overflow primary bitumen froth and solids may sink to produce underflow primary tailings;

withdrawing a watery middlings stream from the mid-section of the primary separation vessel, said stream containing fine solids and bitumen which was incapable of rising to the froth layer in the retention time allowed; and subjecting the middlings to vigorous aeration and agitation in a series of induced air flotation cells, to aerate bitumen and produce an overflow of secondary bitumen froth and an underflow of secondary tailings.

Further yields of froth may be obtained by induced air flotation performed on primary and secondary tailings.

It has long been recognized that the hot water process should be operated to maximize primary froth production and to minimize production of froth by induced air flotation. This is because the secondary-type froth is more heavily contaminated with solids and water than is the primary froth. Typically, primary froth contains about 60% by weight bitumen, while secondary froth only contains about 10–45% bitumen.

It has also long been understood that variations in the quality of the tar sand feed will affect the relative proportions of primary froth and secondary-type froths which are produced. More particularly, a tar sand low in bitumen content and high in fine solids content will produce a relatively small proportion of primary froth and a relatively large proportion of secondary froth, expressed as a percentage of the total bitumen in the feed. This result is attributed in part to the following. It appears that many of the flecks of bitumen in the 'high fines' tar sand slurry are relatively small. These small flecks aerate relatively poorly and hence they are not as buoyant as would be desirable. Also, they seem to become associated with a proportionately larger amount of solids and thus their buoyancy is further deleteriously reduced. And finally, the 'high fines' slurries tend to have a relatively high viscosity due to the high clay content—hence the aerated bitumen has difficulty in rising sufficiently quickly to reach the primary froth layer.

In any event, it is well recognized that it is desirable to improve the hot water process by increasing the proportion of the bitumen reporting as primary froth. This is particularly desirable in connection with the hard-to-process 'high fines' slurries. It is to this end that the present invention is directed.

For purposes of the following description and the claims the term "secondary froth" is intended to encompass any froth produced by induced air flotation in connection with the hot water process—it is not to be limited to the secondary froth produced by induced air flotation of middlings from the primary separation vessel.

SUMMARY OF THE INVENTION

The present invention is based on the discovery that when bitumen recovered as secondary froth is recycled to the hot water process circuit upstream of the primary separation vessel ("PSV"), and becomes part of the feed stream to the PSV, that bitumen is now found to be amenable to recovery as relatively clean primary froth. This secondary froth bitumen which, on its first pass through the PSV lacked the necessary buoyancy to rise and reach the froth layer, now, on the second pass, has achieved this capacity.

The reasons for this change are not conclusively understood. However, it appears that the small globules of secondary froth bitumen become somehow joined with fresh bitumen to yield a sufficiently buoyant product. In addition, it appears that the contaminating water and solids associated with the recycled bitumen become disassociated therefrom to a significant extent and join the water and solids phases of the slurry.

Distinction must be made between the present invention and conventional flotation process recycle schemes, such as are practised in metals flotation. In the metals case, a stream containing a valuable component is recycled to the feed end of the flotation cells, to concentrate all such component into one stream for treatment in a flotation cell. However, in the metals case, the nature of the component is not altered, to the best of applicant's knowledge. Recycle is practised simply to give the component a second chance to be aerated and recovered. In the present case, some bitumen globules fail to float to the froth layer in their first pass through the PSV. They are scavenged in the secondary flotation cells in the form of froth. Recycle is not practised in the secondary recovery circuit. Instead the secondary froth is recycled to a point ahead of the PSV. As a consequence of mixing with the incoming fresh feed, the bitumen is converted from a non-spontaneously floating to a spontaneously floating condition.

Broadly stated the invention is an improvement in the hot water process for extracting bitumen from tar sand, wherein the tar sand is mixed with hot water and process aid and agitated to form a slurry and condition it, oversize material is removed from the slurry, the conditioned slurry is diluted with hot water and retained in a primary separation vessel under quiescent conditions to produce an overflow stream of primary froth and an underflow stream of tailings, a bitumen-depleted stream is withdrawn from the primary separation vessel and is subjected to induced air flotation to produce an overflow stream of secondary froth and an underflow stream of tailings. The improvement comprises: recycling at least part of the secondary froth to that portion of the hot water process which is upstream of the primary separation vessel to join and mix with the feed stream moving to the primary separation vessel; and therafter retaining said feed stream in said primary separation vessel to produce primary froth.

DESCRIPTION OF THE PREFERRED EMBODIMENT

Figure 1:
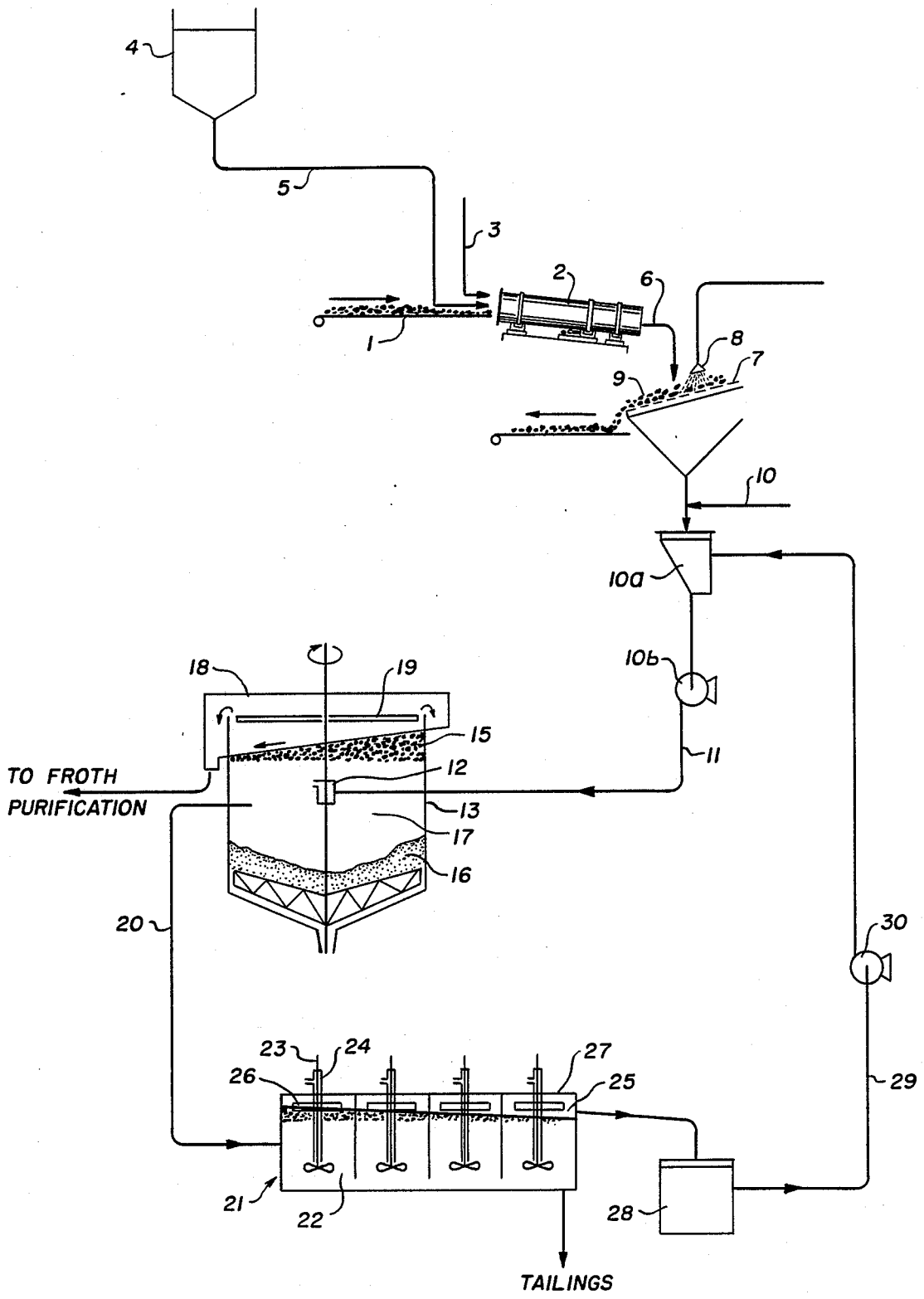
FIG. 1 is a schematic representation of a pilot plant circuit used to carry out the novel process.

The invention is illustrated by the examples set forth below. The data for these examples was developed in the following manner, using the pilot plant illustrated in FIG. 1.

Oil sand feed, whose composition was known from analysis, was added via conveyor 1 to tumbler 2, wherein it was mixed with NaOH and hot water (90° C.), from conduit 3, to produce a slurry. The final slurry temperature was 80° C. The rate of oil sand addition was 0.6 kg/s and the rate of hot water addition was 0.4 kg/s. The sodium hydroxide was added at the rate of 0.02 to 0.05 wt%, expressed as a percentage of oil sand feed, the value chosen being dependent on the oil sand grade. The sodium hydroxide was added as a 10% wt. solution from the storage tank 4 via conduit 5. The residence time of the slurry in the tumbler 2 was less than 10 minutes.

The slurry, prepared and conditioned in tumbler 2, was withdrawn by gravity flow through outlet line 6. It was then screened through a screen 7, maintained in a state of vibration to encourage material to pass therethrough, and continuously washed with hot water from spray 8. Reject matter left above the screen was discarded after weighing and sampling.

The screened slurry was then diluted with further hot water, added via conduit 10, to give a solids content of about 50% by weight in the diluted slurry. The product was piped to pump box **10*a*, whose outlet was in communication with pump 10*b*. Slurry from pump box 10*a* was pumped through line 11 to feed well 12 submerged in primary separation vessel (PSV) 13**.

The slurry was retained in PSV 13 under quiescent conditions and allowed to develop into a primary froth product layer 15, a region 16 formed substantially of coarse solids and water, and a region 17 of largely aqueous middlings. The primary froth product was collected from launder 18, into which it was driven by the entry of further diluted slurry and directed by slowly-moving horizontal rake 19. From launder 18, the primary froth product was advanced to froth purification. Tailings, enriched in coarse solids, was withdrawn from the bottom of region 16 in the PSV and discarded. A stream of middlings was continuously withdrawn from the region 17 through middlings outlet line 20 and advanced to the secondary recovery circuit 21.

The apparatus for performing secondary recovery was a bank of induced air flotation cells 22, arranged in series. Each of the cells 22 was equipped with an agitator 23, capable of vigorously agitating the pulp, and a distributor 24 through which air was introduced. Underflow reject from the first cell was advanced as feed to the second, and so on throughout the entire bank. Underflow from the final cell was discarded as a tailings stream. A secondary froth layer 25, was swept from the cells 22 by wiper blades 26 and combined in launder 27. The secondary froth was collected in tank 28, to await further purification.

Secondary froth from tank 28 was pumped through conduit 29 by centrifugal pump 30 and recycled to pump box **10*a*. Here it was mixed with in-coming fresh diluted slurry to produce a combined feed stream 31 to the PSV 13**.

EXAMPLE 1

Following are the data pertaining to a pilot plant run carried out on a good quality low fines tar sand.

| Feed assay; | |
|---|---|
| 11.4 wt. % | bitumen |
| 4.2 | water |
| 84.6 | solids (20% of which was fines) |

| Sodium hydroxide addition, 0.025 wt. % | | | | | | |
|---|---|---|---|---|---|---|
| | No Recycle | | | With Recycle | | |
| Primary recovery % | | 88.1 | | | 94.0 | |
| Secondary recovery % | | 5.4 | | | — | |
| Combined recovery % | | 93.5 | | | 94.0 | |
| Primary froth assay B/W/S | 64.8 | 25.0 | 10.2 | 64.2 | 26.5 | 9.3 |
| Secondary froth assay | 8.9 | 79.1 | 12.0 | 3.7 | 85.2 | 11.1 |
| Combined froth assay | 44.8 | 44.4 | 10.8 | 64.2 | 26.5 | 9.3 |
| Secondary froth production rate g/s | | 54.5 | | | 127.0 | |
| Amount of secondary froth recycled | | nil | | | all | |

When all the secondary froth was recycled, the bitumen content in the final froth product rose from 44.8 to 64.2 wt%.

EXAMPLE 2

Following are the data pertaining to a pilot plant run carried out on a poor quality high fines tar sand.

| Feed assay: | |
|---|---|
| 8.7 wt % | bitumen |
| 7.8 | water |
| 83.5 | solids (33% of which was fines) |

| Sodium hydroxide addition, 0.05 wt %. | | | | | | |
|---|---|---|---|---|---|---|
| | No Recycle | | | With Recycle | | |
| Primary recovery % | | 22.0 | | | 76.6 | |
| Secondary recovery % | | 51.0 | | | — | |
| Combined recovery % | | 73.0 | | | 76.6 | |
| Primary froth assay B/W/S | 60.1 | 33.7 | 6.2 | 50.4 | 40.5 | 9.1 |
| Secondary froth assay | 36.0 | 50.7 | 13.3 | 33.2 | 53.1 | 13.7 |
| Combined froth assay | 42.9 | 45.8 | 11.3 | 50.4 | 40.5 | 9.1 |
| Secondary froth production rate g/s | | 57.5 | | | 64.5 | |
| Amount of secondary froth recycled | | nil | | | all | |

When all the froth was recycled for this low grade feed, bitumen in the final froth product rose from 42.9 to 50.4 wt%.

EXAMPLE 3

The run of this example used the same feed as Example 2 and the same rate of sodium hydroxide addition, but an air-stream mixture was injected into the slurry ahead of the PSV.

| Feed assay: | |
|---|---|
| 8.7 wt % | bitumen |
| 7.8 | water |
| 83.5 | solids (33% of which was fines) |

Sodium hydroxide addition, 0.05 wt %.

| | No recycle | | | With Recycle | | |
|---|---|---|---|---|---|---|
| Primary recovery % | | 53.3 | | | 84.4 | |
| Secondary recovery % | | 25.7 | | | — | |
| Combined recovery % | | 79.0 | | | 84.4 | |
| Primary froth assay B/W/S | 52.2 | 40.1 | 7.7 | 54.0 | 38.2 | 7.8 |
| Secondary froth assay | 31.9 | 52.9 | 15.2 | 28.8 | 54.3 | 13.9 |
| Combined froth assay | 43.4 | 45.6 | 11.0 | 54.0 | 38.2 | 7.8 |
| Secondary froth production rate g/s | | 54.5 | | | 127.0 | |
| Amount of secondary froth recycled | | nil | | | all | |

When all the secondary froth was recycled, the bitumen content in the final froth product rose from 43.4 to 54.0 wt%. The recovery was at the enhanced level of 84.4%.

The embodiments of the invention in which an exclusive property or privilege is claimed are defined as follows:

1. In the hot water process for extracting bitumen from tar sand, wherein, in a conditioning zone, the tar sand is mixed with hot water and process aid and agitated to form a slurry and condition it, oversize material is removed from the slurry, the conditioned slurry is diluted with hot water and retained in a primary separation vessel under quiescent conditions to produce an overflow stream of primary froth and an underflow stream of tailings, a bitumen-depleted stream is withdrawn from the primary separation vessel and is subjected to induced air flotation to produce an overflow stream of secondary froth and an underflow stream of tailings, the improvement comprising:

recycling at least part of the secondary froth to that portion of the hot water process which is downstream of the conditioning zone and upstream of the primary separation vessel to join and mix with the feed stream moving to the primary separation vessel;

and thereafter retaining said feed stream in said primary separation vessel to produce primary froth.

2. The process of claim 1 wherein the withdrawn bitumen-depleted stream is middlings from the primary separation vessel.

* * * * *